US009649653B2

(12) United States Patent
Sanchez

(10) Patent No.: US 9,649,653 B2
(45) Date of Patent: May 16, 2017

(54) FIXTURE ASSEMBLY FOR SECURING A SPRAY GUN TO A SHAKER

(71) Applicant: Honda Motor Co., Ltd., Tokyo (JP)

(72) Inventor: Julio A. Sanchez, Wapakoneta, OH (US)

(73) Assignee: Honda Motor Co., Ltd., Tokyo (JP)

( * ) Notice: Subject to any disclaimer, the term of this patent is extended or adjusted under 35 U.S.C. 154(b) by 416 days.

(21) Appl. No.: 14/203,758

(22) Filed: Mar. 11, 2014

(65) Prior Publication Data

US 2014/0269149 A1 Sep. 18, 2014

Related U.S. Application Data

(60) Provisional application No. 61/779,418, filed on Mar. 13, 2013.

(51) Int. Cl.
*B05B 15/06* (2006.01)
*B01F 11/00* (2006.01)

(52) U.S. Cl.
CPC ..... *B05B 15/06* (2013.01); *B01F 11/0008* (2013.01); *Y10T 29/49826* (2015.01)

(58) Field of Classification Search
CPC ..... B05B 15/06; B01F 11/0008
USPC ..... 366/114, 110–112
See application file for complete search history.

(56) References Cited

U.S. PATENT DOCUMENTS 2,846,201 A * 8/1958 Mermelstein ..... B01F 11/0008 248/311.2
3,096,081 A * 7/1963 Helm ..... B65B 1/22 141/78
4,316,672 A 2/1982 Kerscher
4,318,622 A * 3/1982 Sterrenberg ..... B01F 11/0008 366/110
4,401,268 A * 8/1983 Pomponi, Jr. ..... B01F 11/0082 239/142
4,420,262 A * 12/1983 Sterrenberg ..... B01F 3/04014 366/110
4,433,812 A * 2/1984 Grime ..... B05B 7/2454 239/290
5,197,802 A * 3/1993 Miller ..... B01F 9/0018 192/18 R
5,439,287 A 8/1995 Roepke, Sr.
5,971,599 A * 10/1999 Bothers ..... B01F 11/0022 366/110
6,709,148 B2 3/2004 Glass
6,945,690 B2 9/2005 Armendariz et al.
7,008,100 B2 * 3/2006 Sergio ..... B01F 11/0008 366/110

(Continued)

OTHER PUBLICATIONS

Website: www.autorefinishdevilbiss.com—Gravity Spray Gun Holders, printed Feb. 7, 2012.

(Continued)

*Primary Examiner* — Abbas Rashid
(74) *Attorney, Agent, or Firm* — Rankin, Hill & Clark LLP

(57) ABSTRACT

A fixture assembly for securing a spray gun to a shaking device includes a body securable to the shaking device. The body includes an open receptacle for at least partially receiving a reservoir of the spray gun. A support member is secured to the body and is configured to support the spray gun on the body while the reservoir is positioned in the open receptacle and shaken by the shaking device.

12 Claims, 4 Drawing Sheets

(56) References Cited

U.S. PATENT DOCUMENTS

| | | | | |
|---|---|---|---|---|
| 7,059,763 | B2 * | 6/2006 | Sordelli | B01F 9/0001 366/217 |
| 7,665,672 | B2 * | 2/2010 | Kosmyna | B05B 7/2408 220/495.02 |
| 7,757,972 | B2 * | 7/2010 | Kosmyna | B05B 7/2478 220/495.02 |
| 7,766,250 | B2 * | 8/2010 | Kosmyna | B05B 7/2408 220/495.02 |
| 7,959,345 | B2 | 6/2011 | Benjamin, II | |
| 7,997,787 | B2 | 8/2011 | Blair | |
| 8,016,218 | B1 * | 9/2011 | Friedman | B01F 11/0017 241/175 |
| 8,465,195 | B1 * | 6/2013 | Boldt | B01F 11/0008 366/110 |
| 8,944,351 | B2 * | 2/2015 | Pellegrino | B05B 7/2408 239/569 |
| 2004/0008568 | A1 * | 1/2004 | Sergio | B01F 11/0008 366/110 |
| 2004/0008573 | A1 * | 1/2004 | MacDonald | B01F 11/0008 366/209 |
| 2004/0013031 | A1 * | 1/2004 | Salas | B01F 11/0008 366/141 |
| 2005/0088911 | A1 * | 4/2005 | Sordelli | B01F 9/0001 366/217 |
| 2010/0310782 | A1 * | 12/2010 | Wawrzyniak | A61B 17/00491 427/445 |

OTHER PUBLICATIONS www.shoptoolsforpros.com—Paint Shaker Stand, printed Feb. 7, 2012.

* cited by examiner 340
340
218
204
222
354
358
216
318
370
322
352
200
214
330
202
212
314
374
356
310
304
280
334
372
302
360
220
350
332
312
280
248
246
320
324
232
240
316
410
262
256
420
252
266
410
272
250
268
390
254
386
244
242
392
410
274
394
260
270
230
264
234
380
410
382
424

100

FIXTURE ASSEMBLY FOR SECURING A SPRAY GUN TO A SHAKER

BACKGROUND

Low pressure die-casting involves low pressure casting dies and permanent mold dies that are coated with a coating material prior to the respective dies being set in casting machines. The coating material is generally applied manually and in steps to achieve a desired coating thickness. Between the steps the coating material is baked on in an oven. Before applying the coating material, the operator must manually mix the contents or particulates of the coating material contained in a reservoir fluidly connected to a spray gun, such as a paint sprayer. During non-coating time, the particulates of the coating material tend to sink to the bottom of the reservoir. Therefore, if the coating material within the reservoir is not properly shaken or mixed prior to application it can result in a thin coating application. A typical reservoir can weigh approximately 3 pounds (1.36 kilograms) and to properly disperse the particulates of the coating material prior to application, the reservoir together with the spray gun is shook for approximately 5 seconds. The operator can repeat this process multiple times during die coating. Further, because one operator can perform this process differently than another operator (e.g., by shaking the coating reservoir more aggressively and for a different length of time), the quality of the coating application may not be consistent from one operator to another operator.

BRIEF DESCRIPTION

In accordance with one aspect, a fixture assembly for securing a spray gun to a shaking device comprises a body securable to the shaking device. The body includes an open receptacle for at least partially receiving a reservoir of the spray gun. A support member is secured to the body and is configured to support the spray gun on the body while the reservoir is positioned in the open receptacle and shaken by the shaking device.

In accordance with another aspect, an assembly for mixing a coating material contained in a reservoir fluidly connected to and suspended from a spray gun comprises a shaking device and a fixture assembly mounted atop the shaking device. The fixture assembly includes a body having an open receptacle for at least partially receiving the reservoir of the spray gun. A support member is secured to the body and configured to support the spray gun. The support member includes a portion configured to engage a handle of the spray gun.

In accordance with yet another aspect, a method of mixing a coating material contained in a reservoir fluidly connected to and suspended from a spray gun is provided. The method comprises mounting a first fixture on a shaking device; providing an open receptacle on the first fixture dimensioned to receive the reservoir; mounting a second fixture on the first fixture; and mounting the spray gun to the second fixture.

DETAILED DESCRIPTION

It should, of course, be understood that the description and drawings herein are merely illustrative and that various modifications and changes can be made in the structures disclosed without departing from the present disclosure. In general, the figures are not to scale. It will also be appreciated that the various identified components of the present disclosure are merely terms of art that may vary from one manufacturer to another and should not be deemed to limit the present disclosure.

Figure 1:
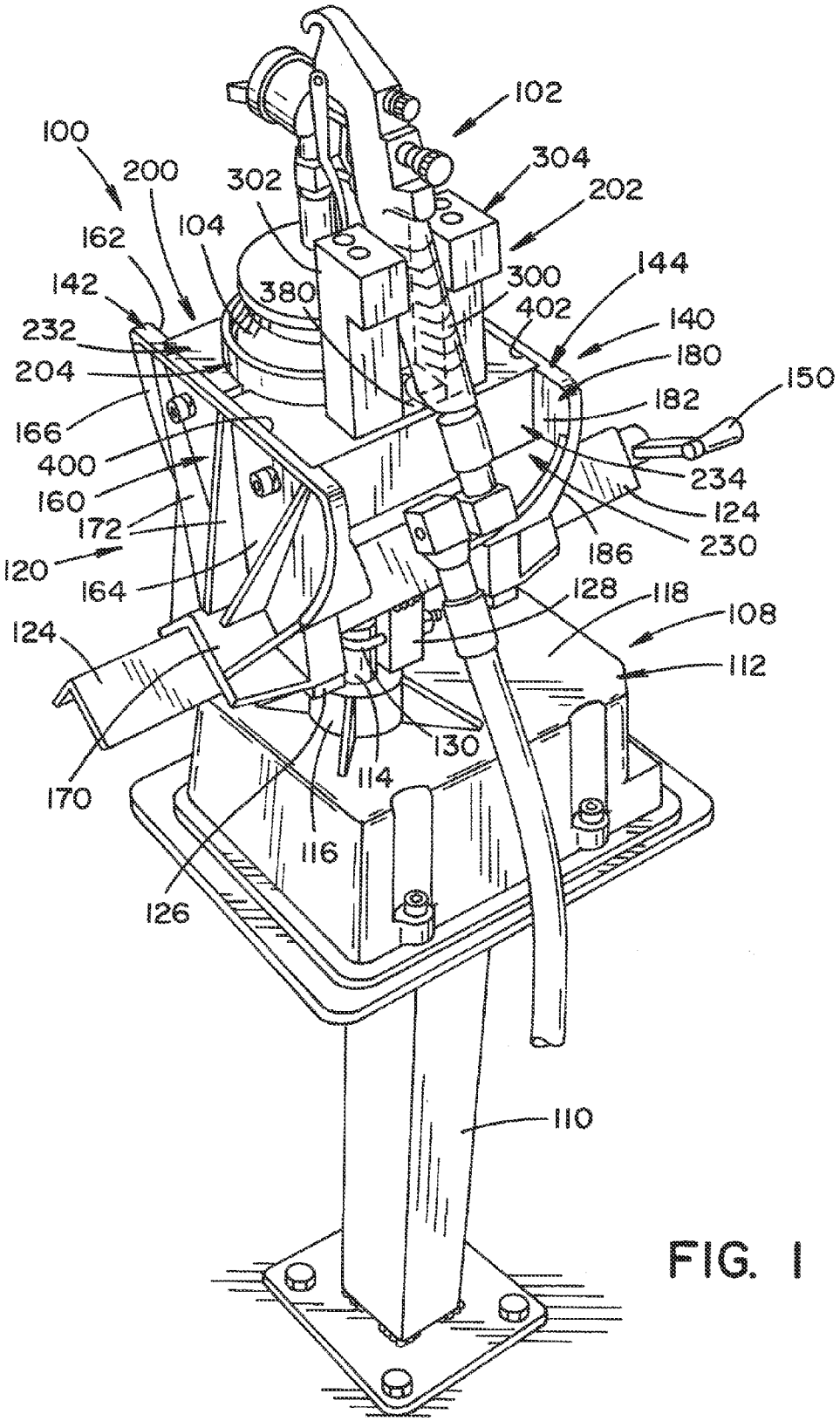
FIG. 1 is a perspective view of an exemplary fixture assembly for securing a spray gun and a reservoir suspended from the spray gun to a shaking device, such as a paint shaker.
Figure 2:
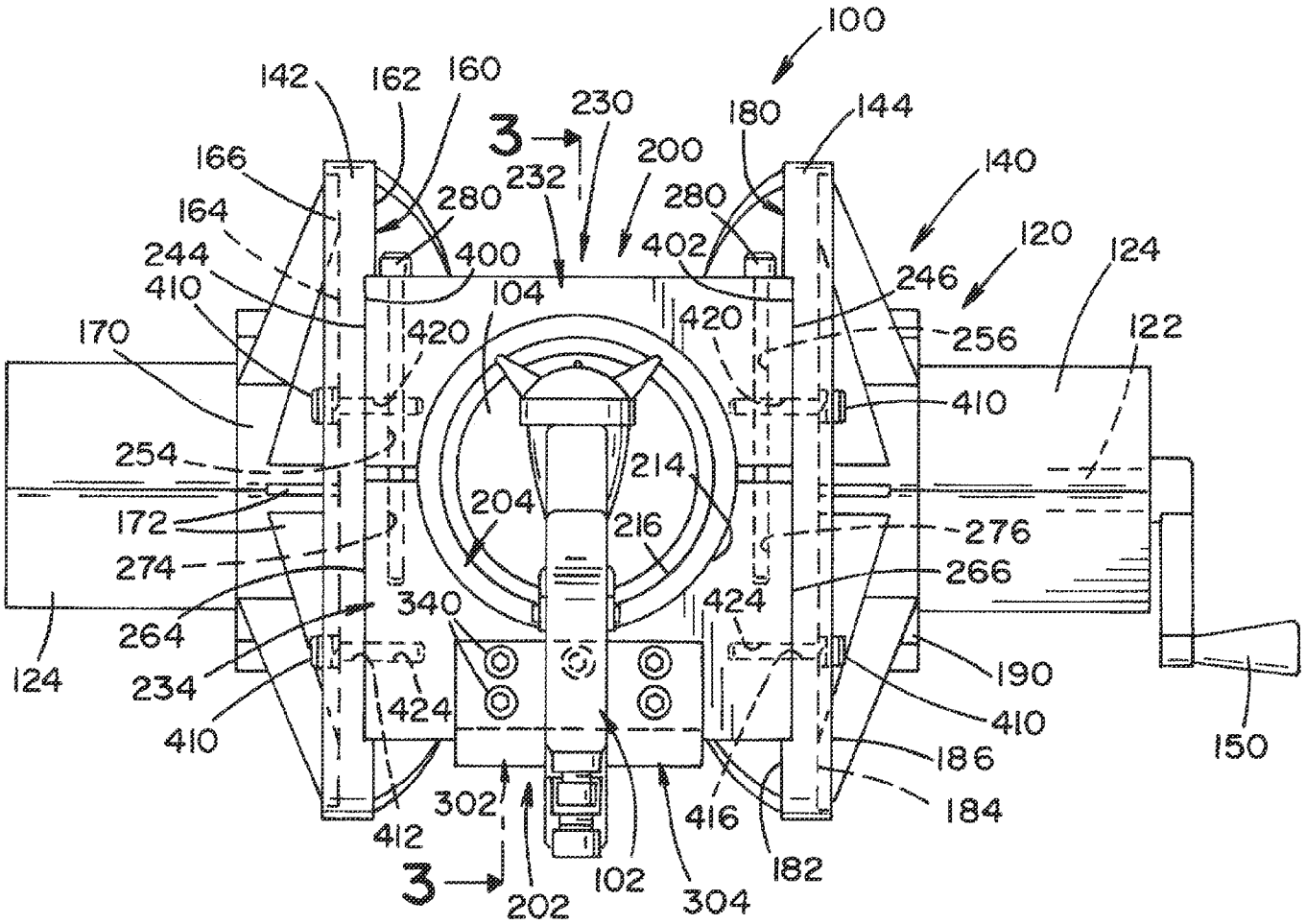
FIG. 2 is a top view of the fixture assembly of FIG. 1.
Figure 3:
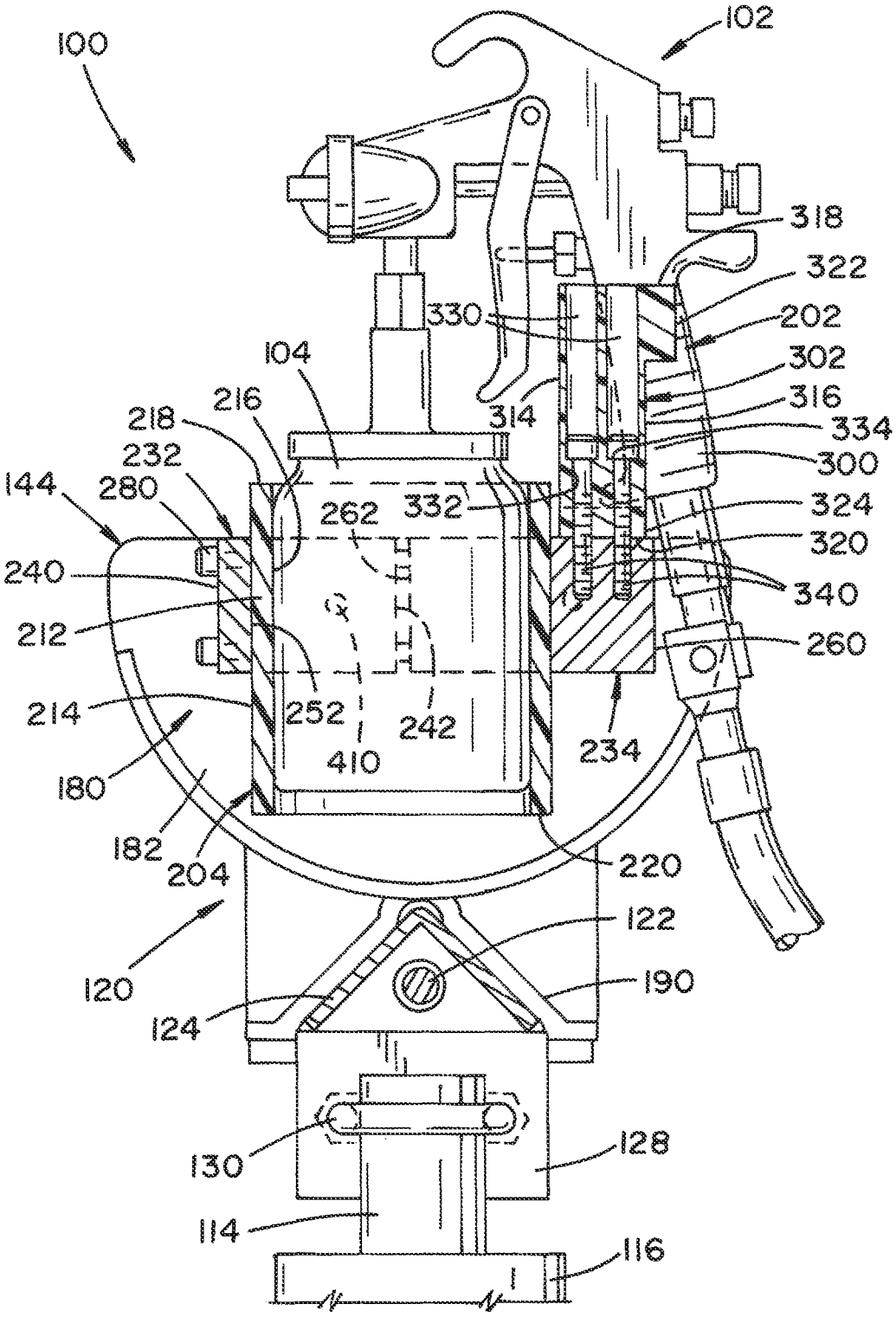
FIG. 3 is a cross-sectional view taken along line 3-3 of FIG. 2.

Referring now to the drawings, wherein like numerals refer to like parts throughout the several views, FIG. 1 illustrates an exemplary fixture assembly 100 for securing a spray gun 102 and a reservoir 104 suspended from and in fluid communication with the spray gun to a shaking device 108. The shaking device 108 can be supported on a pedestal 110; although, this is not required. The shaking device 108 includes a housing 112 within which is an electric motor (not shown) for oscillating a main shaft or arm 114 back and forth. The arm 114 projects upwardly from a fitting 116 provided on a top wall 118 of the housing 112. The mechanism for oscillating the arm 114, which is housed in the housing 112, is conventional and further description thereof is not necessary. Suffice to say that the arm 114 oscillates for shaking the reservoir 104 mounted on the shaking device 108 via the fixture assembly 100. With reference to FIGS. 2 and 3, the oscillating arm 114 mounts a cradle assembly 120 to the shaking device 108. The cradle assembly 120 includes an elongated threaded rod 122 provided beneath an inverted V-shaped frame or guard 124. The guard 124 is provided with a pair of spaced supports 126,128 which extend downwardly from the guard 124. The arm 114 is located between the supports 126, 128 and is secured to one of the supports (e.g., support 128) via a fastening member 130, such as a U-shaped bolt.

The cradle assembly 120 further includes a clamping fixture 140 having a pair of jaws or cradle heads 142, 144. The pair of cradle heads 142, 144 is slidably carried on the threaded rod 122 on opposite sides of the arm 114. Particularly, the threaded rod 122 threadingly engages with each of the cradle heads 142, 144 and has reverse threads on opposite sides of the arm 114. The threaded rod 122 includes a handle 150 for manual rotation of the rod 122. The rod 122 is also fixed against axial movement relative to the arm 114. By rotation of the handle 150, the reversely threaded portions of the rod 122 enable the cradle heads 142, 144 to be displaced toward and away from one another.

As shown in FIGS. 1 and 2, cradle head 142 includes a vertical wall 160 having an inner surface 162 and an outer surface 164. A rim 166 extends along opposite sides and a top of the wall 160. A base member 170 is provided on a lower end portion of the wall 160 and has a shape substantially the same as the guard 124. This allows the base member 170 to sit atop of the guard 124 (i.e., be supported by the guard 124) and move along a length of the guard as the handle 150 is rotated. Strengthening members, such as the depicted gussets 172, extend between the outer surface 164 of the wall 160 and the base member 170. Cradle head 144 has a configuration similar to cradle head 142 and includes a vertical wall 180 having an inner surface 182 and an outer surface 184, a rim 186 and a base member 190.

With reference to FIGS. 1-4, the fixture assembly 100, which again is configured to secure the spray gun 102 and reservoir 104 to the shaking device 108, includes a body 200 and a support member 202 secured to the body. The body 200 is securable to the shaking device 108, and includes an open receptacle 204 for at least partially receiving the reservoir 104 that is suspended from the spray gun 102. As depicted, the open receptacle 204 is defined by a cylindrical shaped wall 212 having an outer surface 214, an inner surface 216, an open top end portion 218 and a bottom end portion 220. The bottom end portion 220 can also be opened; although, this is not required. The inner surface 216 of the cylindrical shaped wall 212 defines a bore 222 that extends between the top end portion 218 and the bottom end portion 220. The bore 222 is dimensioned to frictionally receive the reservoir 104, such that once positioned in the receptacle 204, an outer surface of the reservoir 104 is in constant contact with the inner surface 216. It should also be appreciated that the open receptacle 204 can be formed of a polymer material which allows the receptacle 204 to be at least partially compressed by the body 200. Further, the fixture assembly 100 is adapted so that a longitudinal axis defined by the open receptacle 204 is oriented substantially vertical relative to the shaking device 108.

Figure 4:
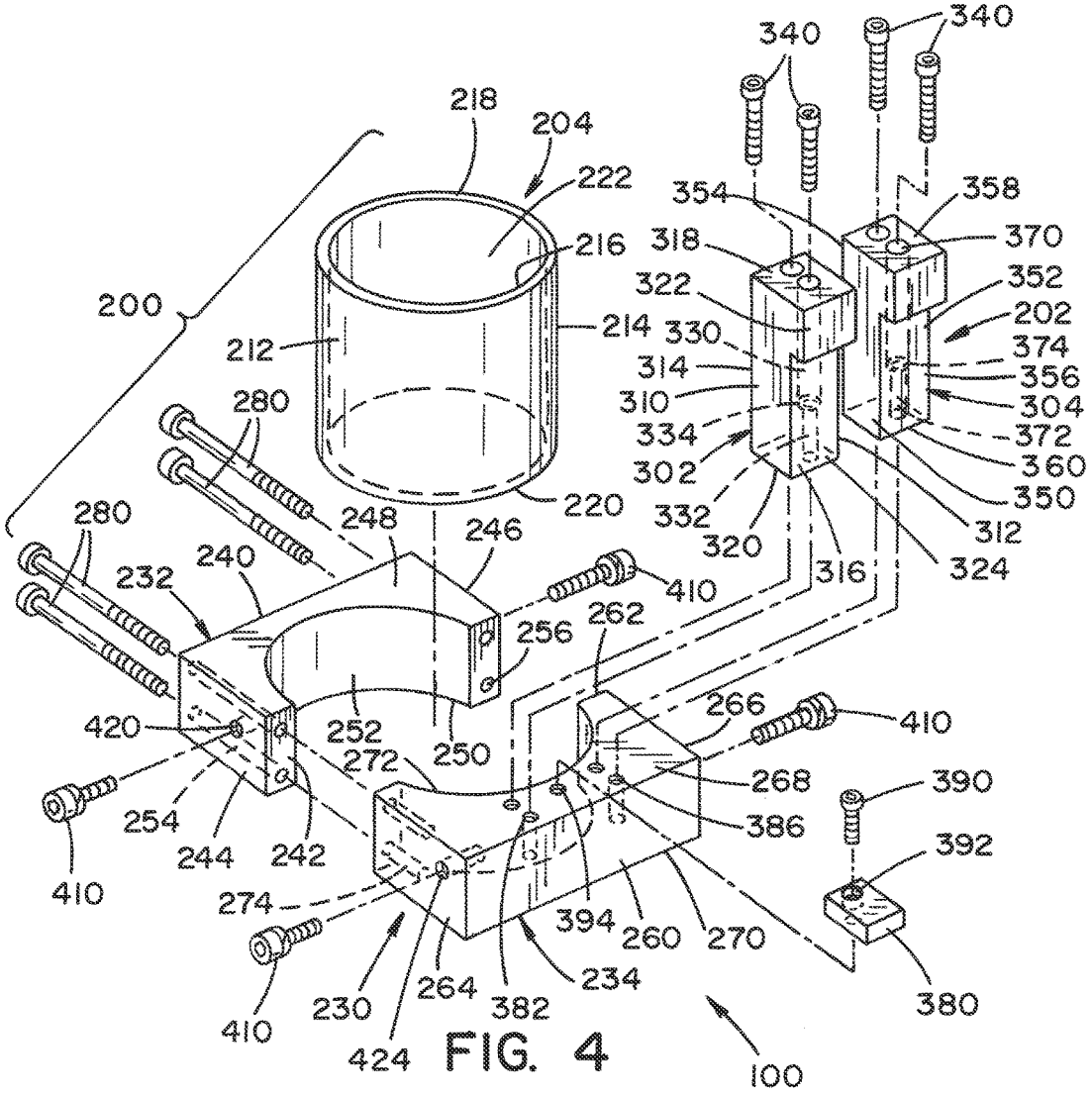
FIG. 4 is an exploded perspective view of the fixture assembly of FIG. 1.

The body 200 of the fixture assembly 100 also includes a sleeve holder 230 and the open receptacle is located in the sleeve holder 230 such that the sleeve holder supports the reservoir 104 during operation of the shaking device 108. As best depicted in FIG. 4, the sleeve holder 230 includes a first part 232 and a second part 234 releasably secured to the first part. The first part 232 includes an outer wall 240, an inner wall 242, a pair of end walls 244, 246, a top wall 248 and a bottom wall 250. At least a portion 252 of the inner wall 242 is arcuate shaped. At least one bore 254 is located adjacent the end wall 244 and at least one bore 256 is located adjacent the end wall 246. Each of the bores 254, 256 extends between the outer wall 240 and inner wall 242. Similarly, the second part 234 includes an outer wall 260, an inner wall 262, a pair of end walls 264, 266, a top wall 268 and a bottom wall 270. At least a portion 272 of the inner wall 262 is also arcuate shaped. As will be appreciated, the arcuate portions 252, 272 of the respective inner walls 242, 262 receive and support the open receptacle 204 disposed between the first and second parts 232, 234. At least one threaded opening 274 is located adjacent the end wall 264 and at least one threaded opening 276 is located adjacent the end wall 266. The threaded openings 274, 276 are aligned with the respective bores 254, 256 (see FIG. 2).

With continued reference to FIGS. 1-4, the support member 202 is configured to support a handle 300 of the spray gun 102 on the body 200 while the reservoir 104 is positioned in the open receptacle 204 and shaken by the shaking device 108. To that end, the support member 202 includes a first support member 302 and a second support member 304 spaced from the first support member 302 a distance slightly greater than a width of the handle 300. The handle 300 of the spray gun 102 is securely positioned between the first and second support members 302, 304. As shown, each of the first and second support members 302, 304 can have an inverted L-shape. Particularly, the first support member 302 includes a pair of side walls 310, 312, a pair of end walls 314, 316, a top wall 318 and a bottom wall 320. An upper portion 322 of the end wall 316 protrudes outwardly from a lower portion 324 of the end wall 316. At least one bore 330 is located on the top wall 318 and extends through the first support member 302 to the bottom wall 320. The bore 330 can include a reduced dimensioned portion 332 that defines a seat 334 for a fastener 340. Similarly, the second support member 304 includes a pair of side walls 350, 352, a pair of end walls 354, 356, a top wall 358 and a bottom wall 360. At least one bore 370 is located on the top wall 358 and extends through the second support member 304 to the bottom wall 360. The bore 370 can also include a reduced dimensioned portion 372 that defines a seat 374 for a fastener 340. The support member 202 can further include a third support member 380 located between the first and second support members 302, 304 and secured to the second part 234 for supporting a bottom of the handle 330 of the spray gun 102.

With particular reference to FIG. 4, to assemble the body 200 of the fixture assembly 100, the open receptacle 204 can first be positioned between the first and second parts 232, 234 of the sleeve holder 230. The first part 232 is then secured to the second part 234 via the fasteners 280. Each fastener 280 extends through one of the bores 254, 256 and engages one of the threaded openings 274, 276. Tightening of the fasteners 280 draws the first and second parts 232, 234 together, thereby securing the receptacle 204 between the arcuate portions 252, 272. The support member 202 can then be mounted to the body 200. Particularly, the first support member 302 is positioned on the top wall 268 of the second part 234, the bore 330 being aligned with a threaded opening 382 located on the top wall 268, and the end wall 316 facing away from the arcuate portion 272. Similarly, the second support member 304 is positioned on the top wall 268 of the second part 234, the bore 370 being aligned with a threaded opening 386 located on the top wall 268, and the end wall 356 facing away from the arcuate portion 272. The first and second support member 302, 304 are then secured to the second part 234 via the fasteners 340, which are positioned in the bores 330, 370 and threadingly engage the openings 382, 386. The third support member 380 is then positioned between the first and second support members 302, 302, and is mounted to the top wall 268 of the second part 234 via a fastener 390 that extends though an aperture 392 located on the third support member and threadingly engages an opening 394 located on the top wall 268 of the second part 234. It should be appreciated that the above described assembly of the fixture assembly 100 is by way of example only and that the sequence of the assembly can be changed.

With reference back to FIGS. 1 and 2, to secure the assembled fixture assembly 100 to the cradle assembly 120, the fixture assembly 100 is placed between the cradle heads 142, 144 of the clamping fixture 140 of the cradle assembly 120 and the handle 150 is turned to move the cradle heads toward one another and into engagement with the fixture assembly 100. To properly position the fixture assembly 100, the inner surface 162 of the wall 160 of the cradle head 142 includes a groove 400, and the inner surface 182 of the wall 180 of the cradle head 144 includes a corresponding groove 402. The groove 400 is dimensioned to receive the end wall 244 of the first part 232 of the sleeve holder 230 and the end wall 264 of the second part 234 of the sleeve holder. Similarly, the groove 402 is dimensioned to receive the end wall 246 of the first part 232 of the sleeve holder 230 and the end wall 266 of the second part 234 of the sleeve holder. Once positioned in the grooves 400, 402, fasteners 410 can then be used to securely fasten the body 200 to the clamping fixture 140. The fasteners 410 extend though openings 412 in the wall 160 and openings 416 in the wall 180 and threadingly engaging corresponding openings 420 in the end walls 244, 246 of the first part 232 and corresponding openings 424 in the end walls 264, 266 of the second part 234. Once secured to the clamping fixture 140, the fixture assembly 100 spans between the cradle heads 142, 144, and the sleeve holder 230 is suspended a predetermined distance above the shaking device 108. The spray gun 102 and reservoir 104 suspended from a dispensing portion of the spray gun can then be mounted to the fixture assembly 100. The reservoir 104 is placed in the open receptacle 204 and the handle 300 is held between the first and second support members 302, 304, with a lower portion of the handle 300 being supported by the third support member 380. Thus, the present fixture assembly 100 mounted atop the shaking device 108 is designed to relieve the operator from manually shaking the spray gun 102 and reservoir 104 multiple times during a coating process.

The present disclosure also provides a method of assembling a fixture assembly 100 for mixing a coating material contained in the reservoir 104 fluidly connected to and suspended from the spray gun 102. The method includes mounting a first fixture 200 on the shaking device 108; providing the open receptacle 204 on the first fixture dimensioned to receive the reservoir; mounting a second fixture 202 on the first fixture 200; and mounting the spray gun 102 to the second fixture 202. The mounting of the spray gun step further includes providing first and second spaced support members 302, 304 for the second fixture 202 and securing the handle 300 of the spray gun 102 between the first and second support members 302, 304. The providing of the open receptacle step further includes mounting the open receptacle 204 in a corresponding opening (defined by the arcuate portions 252, 272 of the respective first and second parts 232, 234) located on the first fixture 200 so that a longitudinal axis defined by the open receptacle 204 is substantially vertical relative to the shaking device 108.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An assembly for mixing a coating material contained in a reservoir fluidly connected to and suspended from a spray gun, the assembly comprising:

a shaking device;

a fixture assembly mounted atop the shaking device, the fixture assembly including a body having an open receptacle for at least partially receiving the reservoir of the spray gun, and a support member secured to the body and configured to support the spray gun, the support member including a portion configured to engage a handle of the spray gun; and a clamping fixture mounted to the shaking device, the clamping fixture including a pair of spaced walls displaceable toward and away from one another, the walls configured to engage and secure the body to the shaking device.

2. The assembly of claim 1, wherein the body includes a sleeve holder secured to the clamping fixture, the open receptacle being located on the sleeve holder.

3. The assembly of claim 2, wherein, each wall of the clamping fixture includes a groove formed therein for receiving the sleeve holder.

4. The assembly of claim 2, wherein the support member includes spaced apart first and second support members secured to the sleeve holder and configured to engage outermost sides of the handle of the spray gun.

5. The fixture assembly of claim 4, wherein each of the first and second support members has an inverted L-shape.

6. The assembly of claim 4, wherein the support member includes a third support member located between the first and second support members, the third support member in contact with and configured to support a bottom of the handle.

7. The fixture assembly of claim 1, wherein the body includes a sleeve holder for supporting the reservoir during operation of the shaking device.

8. The fixture assembly of claim 7, wherein the open receptacle is located in the sleeve holder.

9. The fixture assembly of claim 8, wherein a longitudinal axis defined by the open receptacle is oriented substantially vertical relative to the shaking device.

10. The fixture assembly of claim 7, wherein the clamping fixture is mounted to the sleeve holder and configured to suspend the sleeve holder a predetermined distance above the shaking device.

11. The fixture assembly of claim 10, wherein the pair of spaced walls of the clamping fixture has first end portions mounted to the sleeve holder and second end portions mounted to the shaking device, the first end portion of each of the pair of spaced walls including a groove formed therein for receiving the sleeve holder.

12. The fixture assembly of claim 11, wherein the clamping fixture is secured to the sleeve holder via fasteners.

* * * * *